United States Patent [19]

Dalbo

[11] Patent Number: 4,838,426

[45] Date of Patent: Jun. 13, 1989

[54] COMBINATION OF NEEDLE CASE AND NEEDLE THREADER FOR NEEDLEWORK

[75] Inventor: Emil J. Dalbo, Tucker, Ga.

[73] Assignee: Dal-Craft, Inc., Tucker, Ga.

[21] Appl. No.: 142,660

[22] Filed: Jan. 11, 1988

[51] Int. Cl.[4] ..... B65D 69/00

[52] U.S. Cl. ..... 206/574; 40/621; 206/350; 206/380; 206/818; 211/70.6; 211/DIG. 1; 223/109 A; 248/309.4; 335/285

[58] Field of Search ..... 206/380, 382, 350, 818, 206/574; 223/102, 109 A, 99; 248/206.5, 309.4; 211/DIG. 1, 70.6; 269/8; 335/285; 40/600, 621

[56] References Cited

U.S. PATENT DOCUMENTS

| | | | |
|---|---|---|---|
| 24,070 | 5/1859 | Wheeler | 206/380 |
| 2,600,589 | 6/1952 | Swanson | 206/350 X |
| 2,825,447 | 3/1958 | Kurland | 206/818 X |
| 3,007,568 | 11/1961 | Kurland | 206/818 X |
| 3,150,296 | 9/1964 | McIntosh | 40/621 X |
| 3,838,801 | 10/1974 | David | 223/99 |
| 4,100,684 | 7/1978 | Berger | 206/818 X |
| 4,664,302 | 5/1987 | Dalbo et al. | 223/109 A X |

FOREIGN PATENT DOCUMENTS

| | | | |
|---|---|---|---|
| 1159022 | 2/1958 | France | 206/818 |
| 540576 | 3/1956 | Italy | 206/380 |
| 593575 | 5/1959 | Italy | 206/380 |
| 277953 | 9/1951 | Switzerland | 206/382 |
| 385367 | 3/1965 | Switzerland | 335/285 |

*Primary Examiner*—Bryon P. Gehman
*Attorney, Agent, or Firm*—James B. Middleton

[57] ABSTRACT

A needle case for needlecraft work has a magnet on one side to allow the case to be held on the magnet board. The magnet holds the case for mounting but does not hold the needles within the case. A needle threader has a flat threader that can be inserted through the eye of a needle until an eye of the threader extends through the needle. A shoulder on the needle threader stops the needle, and a notch in the threader communicates with the eye of the threader for ease in passing yarn into the eye of the threader. The needle threader is made of a ferromagnetic material, and may be held on the magnet of the needle case. Further, the needle threader can be held on the magnet of the needle case, and remain there when the needle case is carried by a magnet board.

1 Claim, 2 Drawing Sheets

19
18
16
15
14
10
11
12
30

26
32
35
25
28
29
34
31
36
42

12
14
11
21
18
10
20
19

28
25
35
32
26
29
42
36
34
31
41
40

44
11
49
48
10
19

11
48
49
45
46
16
44
19

COMBINATION OF NEEDLE CASE AND NEEDLE THREADER FOR NEEDLEWORK

INFORMATION DISCLOSURE STATEMENT

For those who do needlework, it is obviously necessary to have available a plurality of needles, generally including several different sizes of needles. Also, it is extremely important to have a needle threader for these needles since the thread, or yarn, used in much of the needlecraft work is sufficiently large and bulky that it is virtually impossible simply to insert the end of the yarn through the eye of the needle. In view of these necessities, it is quite common for a person doing needlecraft to have some form of box or case in which to keep needles, and to have some form of needle threader.

The needle cases in the past have usually been simple containers, usually cylindrical in form, and having some form of cap. While such containers will obviously hold needles, the cases are difficult to keep up with, and are not readily disposable at a convenient location while a person is sewing. Similarly, there is a commonly used needle threader comprising a flat member insertable through the eye of a needle, the flat member defining a hole therein for receiving the yarn. Of course on withdrawing the flat member, the yarn is pulled through the eye of the needle. However, the prior art needle threaders tend to require close attention to the threading of the needle both to prevent jamming the eye of the needle onto the tapered flat member, and to insert the bulky yarn through the hole in the needle threader.

SUMMARY OF THE INVENTION

This invention relates generally to needlecraft accessories, and is more particularly concerned with a needle case and a needle threader conveniently disposable together and in conjunction with a needlecraft project.

The present invention provides a generally rectangular needle case, preferably formed a plastic material or the like, and including a magnet on one side of the case. A cap is receivable over one end of the case, and the magnet is so sized and located as to prevent interference of the magnet with operation of the cap. The magnet therefore can hold the needlecase in place on a magnet board or other needlecraft accessories, and can further hold the needle threader of the present invention, with or without the needle case's being fixed to a magnet board.

The needle threader of the present invention comprises a generally flat, elongated member having at least one needle threading member protruding therefrom. The needle threading member is of an appropriate width to be received through the eye of a needle, and is sharply defined by shoulders between the needle threading member and the body of the needle threader. The needle threading member may further have an open hook for ease in placing the yarn in the needle threader.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figures 1, 2, 3, 4, 5, 6, 7:
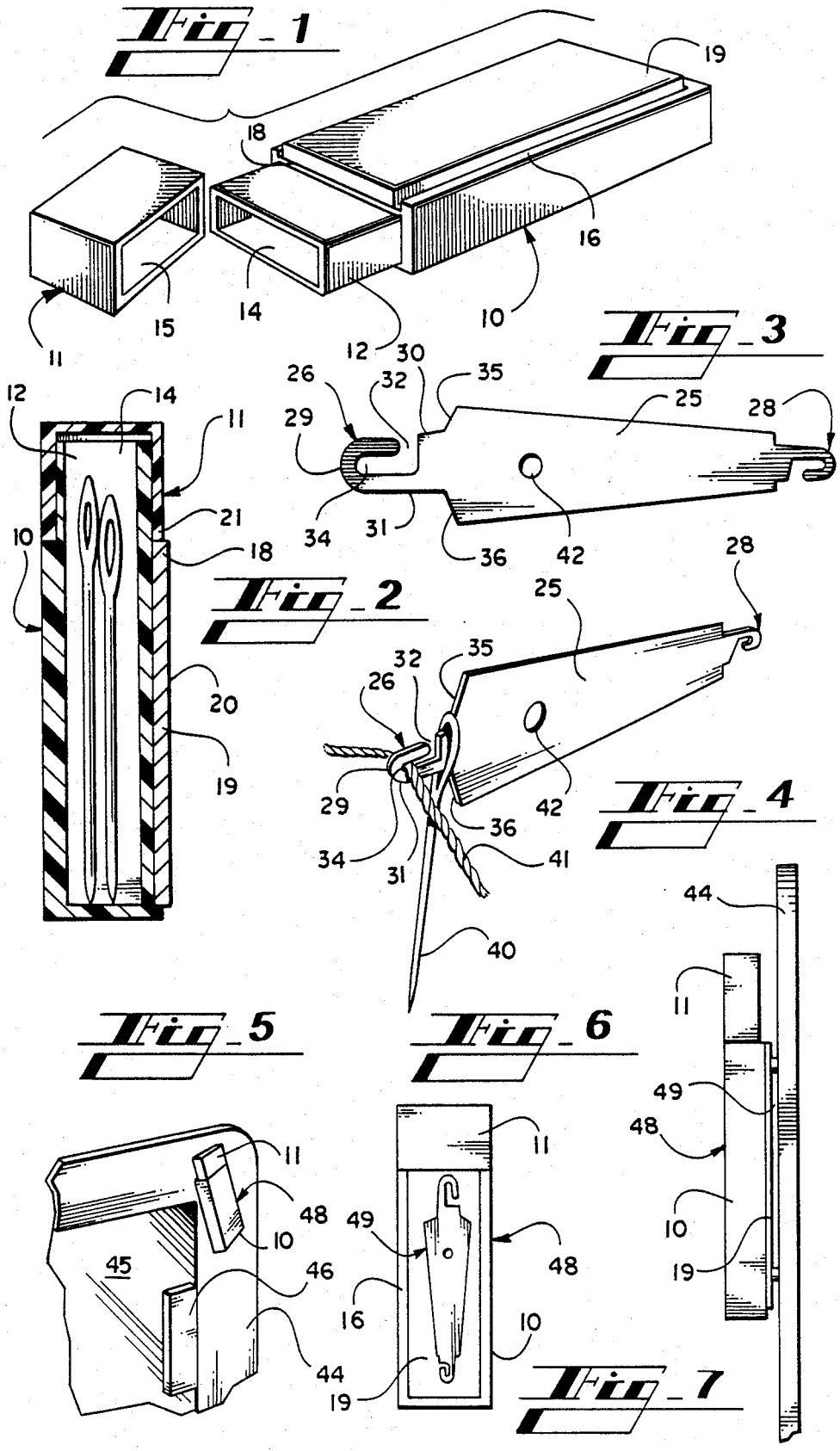
FIG. 1 is a perspective view showing a needle case made in accordance with the present invention, the cap being removed from the case to show the construction.
FIG. 2 is an enlarged, longitudinal cross-sectional view taken through the needle case shown in FIG. 1, the cap being on the case, and containing needles therein.
FIG. 3 is a front elevational view showing a needle threader made in accordance with the present invention.
FIG. 4 is a perspective view showing the needle threader of FIG. 3 in conjunction with a needle and a piece of yarn.
FIG. 5 is a fragmentary perspective view showing a magnet board as used with a needlecraft project, and having the needle case of the present invention mounted thereon.
FIG. 6 is a rear elevational view of the needle case shown in FIGS. 1 and 2 with the needle threader of FIG. 3 carried thereon; and, FIG. 7 is a side elevational view showing a needle case and threader as in FIG. 6 carried by a magnet board.
Figure 9:
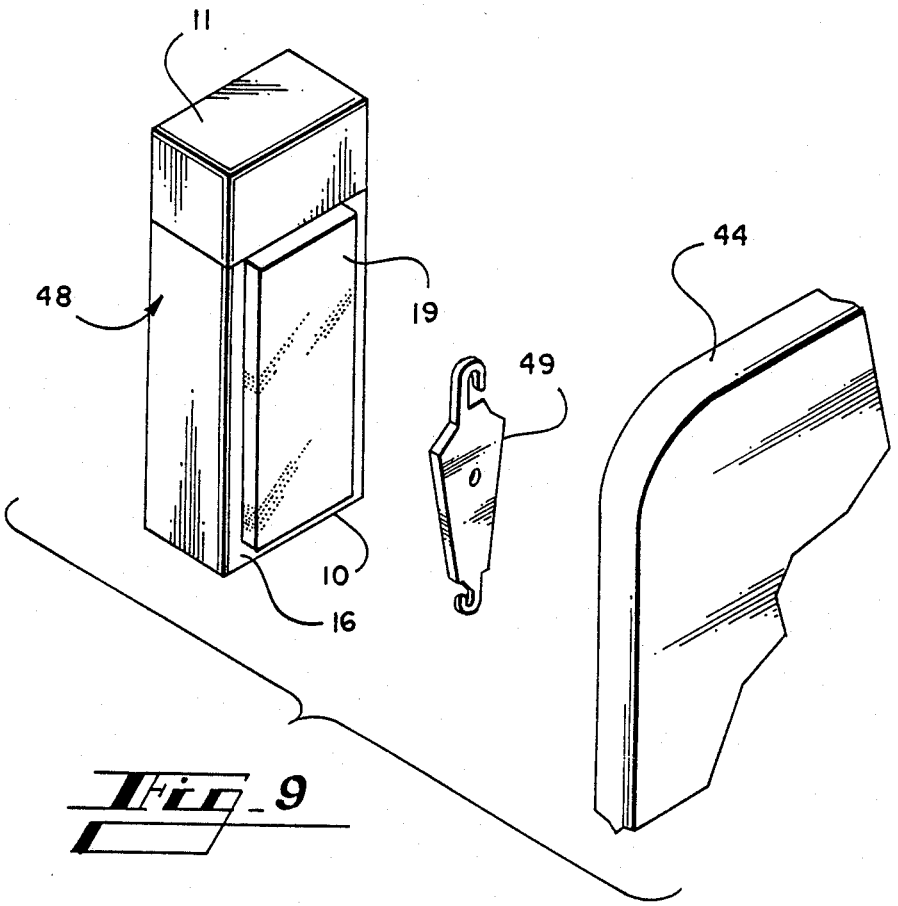
Figure 8:
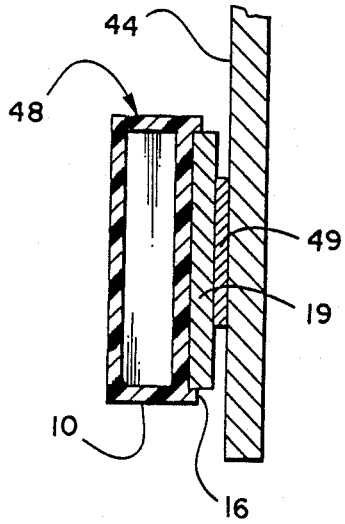

Referring now more particularly to the drawings, and to that embodiment of the invention here presented by way of illustration, FIG. 1 shows a needle case including a body generally designated at 10, and a cap generally designated at 11. The body 10 includes a neck 12 extending therefrom and defining the opening 14 through which needles can be inserted and removed. The neck 12 receives the cap 11, the opening 15 in the cap 11 being sized to be an easy but snug fit over the neck 12 of the body 10.

Looking at FIGS. 1 and 2 of the drawings, it will be noted that the body 10, on one side thereof, defines a peripheral rib 16, the rib 16 extending along three sides of the body 10 to define a recessed area 18. This recessed area receives the magnet 19. It will be obvious to those skilled in the art that the ribs 16 should have a height less than the thickness of the magnet 19. With this arrangement, the recessed area 18 provides a convenient means for determining the ready disposition of the magnet 19, and the magnet 19 can be secured by known adhesives and the like.

With especial attention to FIG. 2 of the drawings, it will be seen that the body 10 of the needle case is generally integrally formed, the walls of the body being thicker in the body area, and simply reduced in thickness to define the neck 12. Similarly, the recessed area 18 comprises one side of the needle case, and the peripheral rib 16 extends therefrom. It will also be noted in FIG. 2 of the drawings that the face 20 of the magnet 19 extends beyond the side 21 of the cap 11. With this arrangement, the cap 11 can be removed from the body 10 even while the needle case is adhered to a ferromagnetic surface by means of a magnet 19.

Turning now to the needle threader shown in FIGS. 3 and 4, it will be seen that the needle threader includes a central body portion 25 having needle threading members 26 and 28 extending therefrom at opposite ends. The two needle threading members 26 and 28 are substantially alike, except that one is smaller than the other in order to thread a wide variety of sizes of needles. The needle threading members 26 and 28 are oriented opposite from each other, and are otherwise alike except for size. With this in mind, only one needle threader member 26 will be described in detail.

The needle threader member 26 has an overall shape including a rounded end 29 merging with tapered edges 30 and 31. The edge 30 is interrupted for the provision of a notch 32 which provides an easy entrance to the eye 34.

It will be seen that the tapered edges 30 and 31 terminate in shoulders 35 and 36. The shoulders 35 and 36 are here shown at and angle of somewhat more than 90° with respect to the tapered edges 30 and 31; however, it should be understood that the particular angle of the shoulders is not extremely important. The purpose of the shoulders is to provide a complete stop for the needle as the threader member 26 extends through the eye of the needle. Thus, a right angle or other angle in the vicinity will operate as well, so long as the angle does not allow the eye of the needle to be jammed on the tapering needle threader.

The threading of the needle is clearly shown in FIG. 4 of the drawings where it will be seen that the needle threading member 26 is extending through the eye of a needle 40. A piece of yarn 41 has been placed through the notch 32 and into the eye 34. With the position as shown in FIG. 4 of the drawings, it will be readily seen that, on withdrawal of the needle threader member 26 from the eye of the needle 40, the yarn 41 will be dragged through the eye of the needle. The needle threader member 26 can then be unhooked from the yarn 41, and the threading can be completed by hand by placing the needle at the desired place along the yarn 41.

Again, the needle threader member 28 will be used in exactly the same manner, but the smaller member 28 can be used for smaller needles.

It will be noted that a generally circular hole 42 is shown in the body 25 of the needle threader. Such a hole can provide means for hanging the needle threader, or collecting a plurality of needle threaders together. It will of course be understood that the hole 42 is optional, and may or may not be provided as desired.

Looking now at FIG. 5 of the drawings for some discussion of the use of the present invention, there is shown a generally conventional magnet board 44. Magnet boards such as the board 44 comprise generally rectangular members of ferromagnetic sheet material. A graph 45 or other pattern to be followed is typically placed against the board 44 and held by a plurality of magnets such as the magnet 46. Since a person doing needlecraft work will very often be utilizing a board such as the magnet board 44, the magnet board 44 also provides a very convenient storage place for the needle case designated at 48. Further, it will be seen that the needle case 48 is oriented with the cap 11 generally upwardly so that the cap 11 can be removed and needles added or subtracted without removing the body 10 of the case from the magnet board 44. Looking also at FIG. 6 of the drawings, it will be seen that the needle case 48 is shown, and having a needle threader generally designated at 49 carried on the magnet 19. It will of course be understood that the needle threader 49 is the same as the needle threaders shown in FIGS. 3 and 4 of the drawings, and is formed of a ferromagnetic material so it will be attracted by the magnet 19. This arrangement provides a very convenient package that can be used and carried independently as shown in FIG. 6, so a person has a plurality of needles and a needle threader held together for ready availability.

Looking then at FIG. 7 of the drawings, the magnet board 44 is shown, and there is a needle case 48 carried on the magnet board 44, with a needle threader 49 received between the magnet 19 on the needle case 48 and the magnet board 44. Thus, as shown in FIG. 5, the needle case 48 may have a needle threader 49 in conjunction therewith. Though one may of course carry the needle threader elsewhere if preferred.

It will therefore be seen that the present invention provides an extremely simple yet highly desirable needle case that is efficient in operation and very easy to use. The provision of the magnet in conjunction with the needle case allows the needle case to be readily held against any ferromagnetic surface; however, it has been found that use of conventional strip magnets having a thickness in the vicinity of around 2 or 3 thirty-seconds of an inch will provide adequate holding power for the needle case without causing the needles to be retained in the case. This same magnet can be utilized to sandwich a needle threader 49 between the magnet 19 and a magnet board 44 or other such surface, thereby providing great variability and convenience for the needleworker.

The particular needle threader of the present invention provides the convenience of two different sized needle threading members; and, after a particular threading member is selected, the member can be rather casually poked through the eye of the needle without careful attention. The needle threader member will of course stop due to the shoulders such as the shoulders 35 and 36. At this time, a yarn can be easily passed through the notch such as the notch 32 and into the eye 34 of the needle threader, again with casual attention so that primary attention can remain on the needle work involved.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. In combination a needle case for receiving a plurality of needles for use in needlecraft work, said case including a body defining a neck at one end thereof, a cap receivable over said neck, said body defining a space for receiving said plurality of needles and said neck defining an opening into said space, said cap covering said opening into said space, and a magnet fixed to one side of said body of said needle case, a needle threader including an elongate body and at least one threading member extending therefrom, said needle threader being formed of ferromagnetic material and being received on said magnet, said combination further including a magnet board for holding instructions for use in needlework, said needle case being carried on said magnet board by adherence of said magnet to said magnet board, said needle threader being disposed between said magnet and said magnet board.

* * * * *